US005852462A

United States Patent [19]

Lloyd et al.

[11] Patent Number: 5,852,462

[45] Date of Patent: Dec. 22, 1998

[54] METHOD AND APPARATUS FOR FORMING HIGH GLOSS IMAGES USING LOW GLOSS TONER FORMULATION

[75] Inventors: Michael B. Lloyd, Boise, Id.; Wallace K. Johnson, Albany, Oreg.

[73] Assignee: Hewlett-Packard Company, Palo Alto, Calif.

[21] Appl. No.: 611,593

[22] Filed: Mar. 7, 1996

[51] Int. Cl.[6] ..... B41J 2/385; B41J 2/435; G03G 9/08; G03G 13/04

[52] U.S. Cl. ..... 347/156; 347/139; 347/155; 347/262; 347/264; 395/200.78; 399/68; 399/45; 271/264

[58] Field of Search ..... 347/155, 139, 347/156, 262, 264; 395/200.34, 200.38, 200.78, 853; 399/66, 68, 85, 130, 69, 67, 45, 389, 396; 271/264, 265.01

[56] References Cited

U.S. PATENT DOCUMENTS 5,321,481 6/1994 Mathers .

FOREIGN PATENT DOCUMENTS 0537671A 4/1993 European Pat. Off. .
0723359A 7/1996 European Pat. Off. .

*Primary Examiner*—Benjamin R. Fuller
*Assistant Examiner*—Raquel Yvette Gordon

[57] ABSTRACT

An electrophotographic laser printing process using dry low gloss toner formulations for producing either low gloss images or high gloss images. In an instance when a low gloss image is produced, the process selects a low gloss paper, and all other parameters of the process of printing low gloss images are consistent with known parameters for the production of electrophotographic low gloss images using dry toner formulations. In order to produce a high gloss image using a low gloss toner formulation, the method involves selecting a high gloss media, if available, from a media source and reducing the feed speed of the media through the process. Additionally, the fuser roller temperature is increased to ensure maximum fixing and fusing of the toner to produce a single voidless plane of toner on top of the media which exhibits a high reflective index and results in less light scattering at the surface of the toner.

20 Claims, 2 Drawing Sheets

METHOD AND APPARATUS FOR FORMING HIGH GLOSS IMAGES USING LOW GLOSS TONER FORMULATION

BACKGROUND OF THE INVENTION

1. Technical Field

This invention generally relates to processes for the formation of images using dry toners and, more specifically, to a process for high gloss image formation using dry low gloss toner formulations.

2. Background Art

The technology of electrophotography, is generally characterized by a process having at least the following steps: charging, exposure, development, transfer and fusing. Additional steps may be taken in producing an image or document including cleaning and erasing the photoconductor.

In the charging step, the photoconductor is covered with ions of a selected polarity using a high voltage wire, grid, or charge roller. Exposure involves the formation of a latent image on the surface of an insulating, photoconducting material by selectively exposing areas of the surface to a high energy light source. A difference in electrostatic charge density is created between the areas on the surface exposed and unexposed to light.

A visible image is developed by electrostatic toners. A dry toner generally has two components, a pigment component and a thermoplastic binding component. The subtractive set of pigments, cyan, magenta and yellow are most commonly used for producing color documents or images using the electrophotographic color laser printing process. Other components may be added to the toner formulation to enhance certain properties or performance characteristics of the toners. These include additives to control the rate and level of charge and additives for enhancing flow. Oil is sometimes added in the fusing process to inhibit adhesion of the toner to the fuser rollers.

The toner is selectively attracted to the photoconductor surface dependent upon the degree of exposure to light and the relative electrostatic charges of the photoconductor surface, development electrode and the toner. The photoconductor may be either positively or negatively charged, and the toner system similarly may contain negatively or positively charged particles.

In the transfer step, media, most often in the form of a sheet of paper, is given an electrostatic charge opposite that of the toner and passed along in close proximity to the photoconductor surface to transfer toner and, consequently, the latent image from the photoconductor surface onto the media. Following transfer of the toner in the form of the latent image from the photoconductor surface to the media, the media is passed between a pair of fuser rollers. The pressure and heat of the rollers fixes the toner in the media.

There are a number of electrophotographic color laser printing processes in use today. Some generate low gloss documents and others generate high gloss output. Gloss is a function of the absorbance characteristics of the media as well as certain characteristics of the toners. Absorbance can be modeled by the Beer-Lambert equation, $$A=\epsilon lc,$$

where A=absorbance, $\epsilon$=extinction coefficient of the dye, l=pathlength of the layer and c=concentration of developed dye.

Reflection density is related to the layer absorbance by the relation, $$d=2(A)+A_{sub},$$

where A=the layer absorbance and $A_{sub}$=the absorbance by the paper base.

Most monochrome laser engines and some color engines generate a document having a low gloss value in the range of 5% which is designed to reduce glare that can lead to eye strain when reading text or mixed text and graphic documents. Some color engines, on the other hand, generate documents where the gloss values may exceed 30%, 40% or even 50%.

Processes for producing high gloss color laser images using a dry toner formulation, to date, have employed lower gloss dry toner formulations together with a large amount of oil in the fusing process. The oil is deposited onto the surface of the media over the toner as it is fused resulting in glossy output. What this has meant in practical terms is maintaining separate printers for each of the two processes, one for readable low gloss text and graphics and another for high gloss photo quality types of images.

It would be desirable to be able to print both high and low gloss black and white images on the same image forming device using the same toner formation for both images. It would also be desirable to devise a process for producing either low gloss color images or high gloss color laser images, which maximize color gamut using the same equipment and toner. As was stated earlier, in order to produce documents having a gloss value in excess of 30%, printing processes using dry toners have employed large amounts of oil in the fusing process. However, it has been found that these high gloss processes are unacceptable for producing documents in the low gloss or 5% gloss mode and images generated in these devices often result in a mottled appearance because the gloss is not always consistent across the page due to the underlying surface roughness of the paper, and the different levels of gloss between the toner and the paper, and the applied oil.

What is needed then is a process which allows for the production of high gloss documents on either a black and white electrographic image forming device or an electrophotographic color image forming device using dry low gloss toner formulations. Therefore, it is one object of this invention to provide an image forming device which can print images having gloss values ranging from a low gloss value to a high gloss value using the same low gloss toner formulation. It is another object of this invention to provide a process which provides for the production of both high gloss documents, low gloss documents, and gloss ranges in between, on an electrophotographic color laser printer using dry low gloss toner formulations which results in increased color gamut.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DISCLOSURE OF THE INVENTION

These objects, and others, are attained by an image forming device, method and system for selectively rendering an image in either a low gloss mode or a high gloss mode which adjusts one or more parameters including the speed of the media as it is fed through the image forming device, the temperature of the fusing rollers, the type of media to which the image is affixed, the pressure applied to the image by the fuser rollers and the bias voltages of the transfer roller and toner.

In general terms, the system employs: a document generating device, such as a personal computer, to generate electronic data representing a document together with an electronic data command representing a desired gloss mode, selected as either a low gloss document mode wherein the document is printed on a low gloss media using a dry low gloss toner or a high gloss document mode wherein the document is printed on a high gloss media using the dry low gloss toner; and an image forming device, such as a color laser printer, which is capable of forming both low and high gloss images using a low gloss toner formulation in response to the gloss mode data command. Alternatively, the image forming device can sense the presence of a specific media type, i.e. low gloss or high gloss media, and/or sense a direct user input at the control panel of the image forming device and react accordingly.

The image forming device includes a formatter which can select a given gloss mode or range or a media type from either a low gloss media source or a high gloss media source based upon the input. The input can come from a number of sources including but not limited to the following: an input device such as a computer, a control panel, a specially configured media tray inserted into the image forming device which is configured to give indication of the media contained therein, or from the media itself through sensors in the image forming device. Once the gloss mode and media have been determined, the formatter processes the data according to the predetermined algorithms and color calibration tables to optimize the color image output according to the mode and media selected.

At the same time the formatter sends the appropriate commands to the print engine to select the given input sources, media, mode and output destination to achieve the desired result. The formatter does not, in all cases, need to provide all of these commands. For instance, in one particularly straight forward embodiment of the invention, a sensor in the image forming device which designed to recognize a high gloss media is set to automatically run the engine in the high gloss mode upon sensing high gloss media in the paper path without a command from the formatter and without any special data processing. The formatter however, if desired, may override this default to achieve the optimum output, or other desired gloss level.

Once the mode has been determined and any data processing completed, the device controls the feed rate of the media through the image forming device and sets the proper electrophotographic parameters associated with that particular feed rate. The density of dry low gloss toner transferred from the photoconductor to the media to form the latent image and the amount of dry low gloss toner fixed to the media is dependent upon these parameters. The level to which the dry low gloss toner is fused to the media is directly related to the feed rate and the temperature of the fuser rollers to control the melting and fusion of the dry low gloss toner to the media.

This invention, when applied to a color image forming device, achieves a maximum amount of gloss and provides increased chroma to maintain a maximum color gamut using a low gloss toner formulation by controlling a combination of parameters during the printing process.

In an alternate embodiment of the invention, the image forming device renders an image having a gloss value selected from a range of gloss values. For example, as before, a low gloss mode could be selected in which a low gloss image is rendered on a low gloss media using a dry low gloss toner formulation or a high gloss mode where a high gloss image is rendered on a high gloss media using a dry low gloss toner formulation. In addition, gloss level modes of selected ranges between the high and low modes could be used to render images of various gloss levels resulting in various levels of chroma. A semigloss image can be produced using a low gloss media in high gloss mode, i.e. reducing the feed rate of the media through the print engine and/or increasing the fuser temperature. A medium gloss image can be rendered using a high gloss media in low gloss mode, e.g. simply printing an image on high gloss paper leaving the feed rate and fuser temperature in their normal low gloss states. Further refinement in additional gloss levels between these four primary levels can be achieved by variations in fusing temperature or the amount of toner applied to the page resulting in a selectable range of gloss levels. Based upon the input, the invention regulates and controls various process parameters to produce a document having the selected gloss value, and at the same time maximizing color gamut.

In the case where an input for a document to be printed indicates that the desired mode of output document selected is a low gloss document, media is selected from a source, typically a tray, containing an acceptable low gloss media. Because the process employs a dry low gloss toner and a compatible low gloss paper, all other parameters of the printing process are consistent with known parameters for the production of electrophotographic low gloss color images using dry toner low gloss formulations.

However, should the input specify a high gloss document or specific document output characteristics which suggest a high gloss document, the formatter selects the proper parameters and modes to produce the highest possible gloss on low gloss media. In addition, if available the image forming device could also select the source or tray containing an appropriate media for the high gloss process. Also, in the case in which the image forming device senses the presence of a high gloss media introduced into the process manually, the print engine control system can be automatically configured to select parameters for a high gloss document, or could be alternately configured to feed back information to a control panel or back to the originator of the document across the network indicating that a high gloss media has been sensed and requesting additional information relating to what the originator would like to do at this point, e.g. cancel the job, continue printing in normal mode, print using a certain defined mode, or reselect an input source to print on low gloss media.

Upon selection or introduction of the high gloss media into the printer, the process employs means for optimizing the transfer of toner to the high gloss media to provide maximum toner coverage and increased density for maximum color gamut. This end is achieved in part by selecting a high gloss media having enhanced conductivity properties so that an increased charge differential is observed in the high gloss media as compared to the low gloss media.

In order to produce a high gloss image using a low gloss toner formulation, the process regulates the feed speed and temperature of the media in the fuser to fuse the toner at a higher temperature. By this speed and temperature regulation the toner is actually heated to a point beyond the normal temperature required for fixing. Normally the outer surface of toner is heated to a point just above glass transition temperature. In high gloss mode the toner is heated far beyond the glass transition temperature so it actually becomes soft and pliable. The dry low gloss toner formulations employed in the devices, methods and systems described and claimed herein have a first melt point between 55° C. to 70° C. This allows the toner to be molded during fusing into a smooth surface layer on top of the media.

With normal low gloss media it is difficult to completely overcome the first surface effects of the base media because of the surface roughness inherent in most low gloss media. This surface roughness is due to voids and fibers apparent at the microscopic level. Unfortunately, the geometry's of the voids and fibers are greater than the sum of the layers of applied toner that can be built up on the surface of the media to fill and cover the voids and fibers. In the case of solid fill patterns, covering the entire media base, it is possible to generate a high gloss mode with low gloss toner in which the individual toner particles melt and fuse together to form a single substantially voidless plane of toner on top of the media which exhibits a high reflective index and results in less light scattering at the surface of the toner than can be generated with normal forming speeds, temperatures and conditions. Under this smooth surface of toner the larger peaks, voids and valleys of the base media still exist.

For applications and images that do not cover 100% of the page, which accounts for the majority of images printed, there will always be a large differential in the gloss of the "low gloss" base media and the "high gloss" image produced with the "high gloss" process mode. Therefore, the highest quality results are accomplished using special high gloss media developed to take full advantage of the high gloss print mode.

In addition or alternatively, the developing process can be optimized by the selection of an appropriate dry toner formulation and corresponding process modifications to increase the mass per unit area of toner developed onto the photoconductor in order to provide for the transfer of a thicker latent image layer onto a media which in turn provides adequate toner, when fused, to fill any microscopic voids in the media while still providing sufficient toner to flow when fused to create an even layer of coverage across the image. The formatter may also be used to adjust the toner amount, dithers, halftone patterns and density by manipulating, processing or reformatting the image in its electronic data format.

Special media is best used for the high gloss process for a number of reasons. First, special media provides for a smoother surface for the toner layer to adhere to. Second, the special media can be coated to match the high gloss level of the toner in the high gloss mode. Third, special media can also be used to diminish edge effects of isolated lines or dots. Fourth, special media can also be tailored to sustain the higher temperatures of the fuser rollers by providing a layer in which the toner can be encapsulated within during the fusing process resulting in the ultimate level of gloss across the entire media. Fifth, special media increases the transfer efficiency by pulling a greater amount of toner across to the media.

The special high gloss media can be encoded to include visual indicia or other indicators to provide feedback to the formatter and/or controller through a sensor. Alternatively, the sensor may be tuned to detect the high gloss level of the coating or coating additives to differentiate the high gloss media from normal low gloss media.

Integrity of the high gloss image and high gloss media can be maintained by the use of an output tray which is selected by the printer engine when printing in the high gloss mode which allows the media to exit the fuser rollers in a straight path and remain flat while the image cools. This avoids document curling, image ripple and media deformation which may occur due to the higher temperatures to which the high gloss media is subjected.

It should be noted that it has been observed that the application or employment of any of the referenced factors, independent of the others, will result in the production of a higher gloss image. The preferred embodiment of the invention comprises a process wherein a plurality of these factors are controlled.

DETAILED DESCRIPTION OF THE INVENTION

Figure 1:
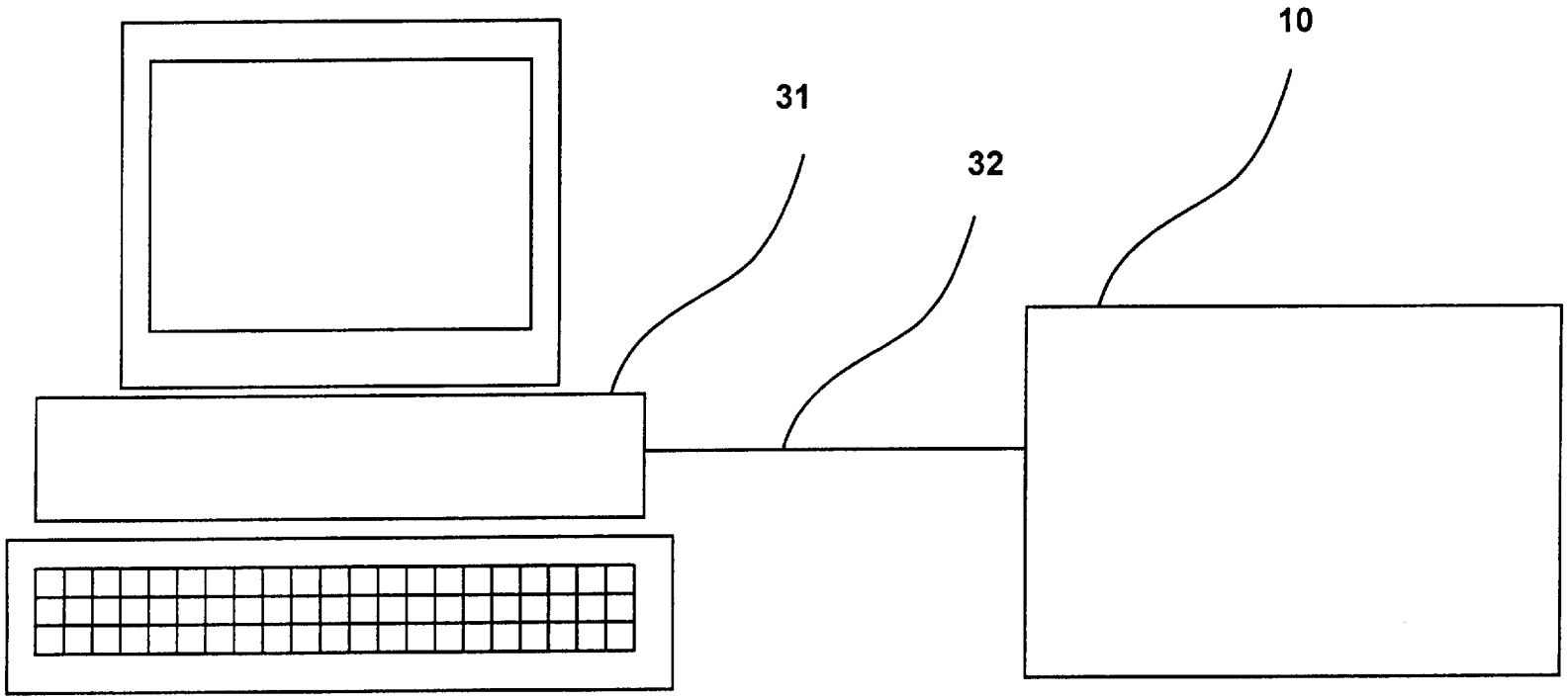
FIG. 1 is a schematic representation of a personal computer system having an attached image forming device according to the invention.
Figure 2:
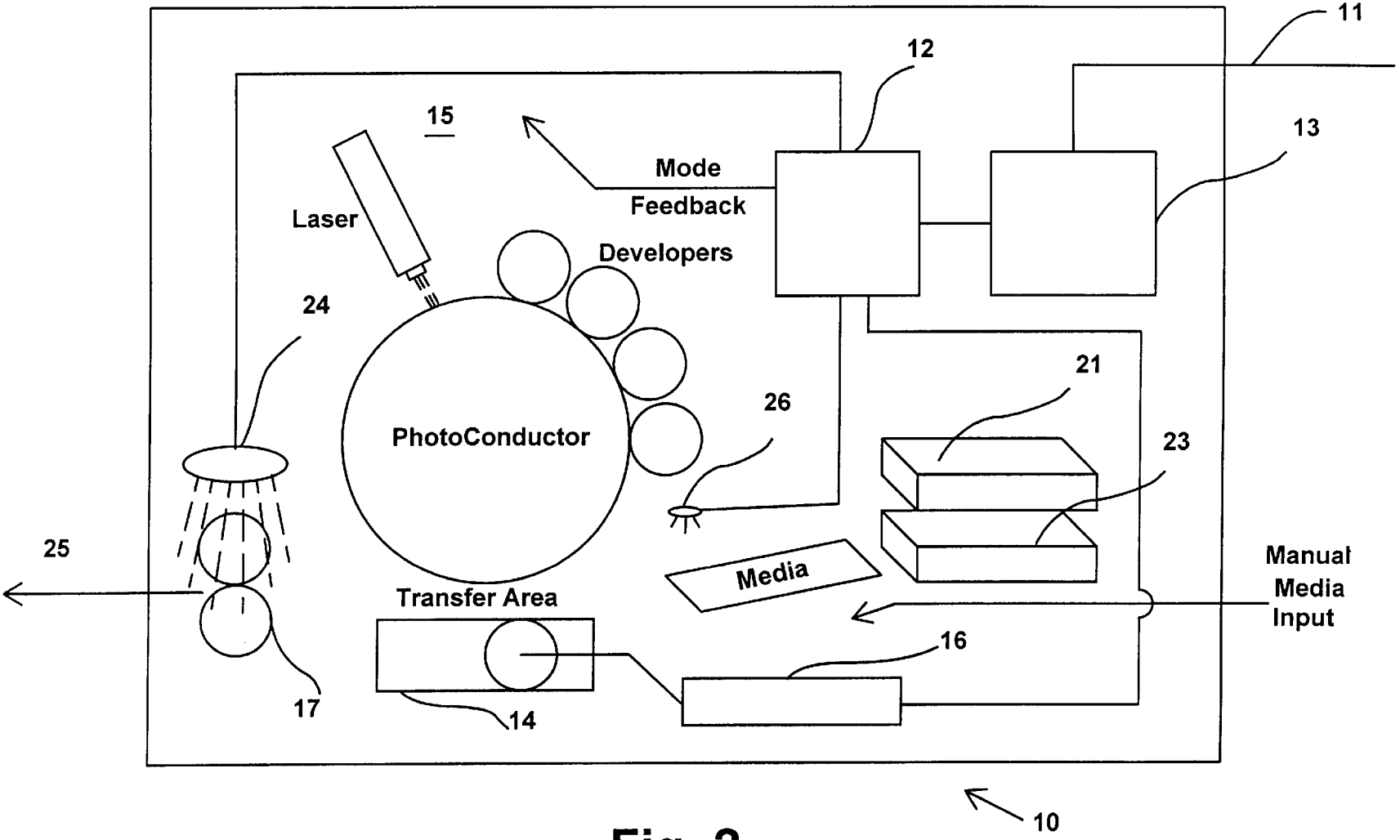
FIG. 2 is a schematic representation of an image forming device according to the invention for producing both high gloss and low gloss images using only a dry low gloss toner formulation.

Referring now to the figures, an image forming device for selectively producing a high gloss color image on a high gloss media using a dry low gloss toner formulation, or for producing a low gloss image on a low gloss media using a dry low gloss toner formulation, is illustrated in schematic representation and is generally designated at 10 in the figures. Throughout both the preceding discussion and that which follows, the image forming device may also be referred to as a printer since the preferred embodiment explained employs a color laser printer to implement the invention. It should be noted however, that the invention is not limited to either laser printers or to color printing processes and can be implemented in various electrographic image forming devices.

In a first embodiment of the invention, a personal computer 31 is connected to printer 10 through parallel cable 32. However, the connection between printer 10 could just as well be through a serial cable connection, network connection, a remote connection via a telecommunication link, an infrared link, a radio frequency link, etc. Computer 31 here includes document generating software and its associated printer driver within the computer's memory. Collectively, these define one of several possible source document generators. In this embodiment of the invention, the source document generator produces an electronic representation of the document to be printed and provides this data as input to printer 10 at input 11. Here, the data input includes information about the desired gloss characteristics which is transmitted to printer controller 12 which in turn determines the mode of printing to be used, either low gloss mode, high gloss mode or some gloss level in between the two. While, in this particular embodiment of the invention, the desired gloss characteristics are generated by computer 31 and transmitted via parallel cable 32 to printer 10, it is to be distinctly understood that the gloss characteristics may originate elsewhere. For example, the user may input desired gloss characteristics through the control panel on printer 10, or sensor 26, which senses the presence of either low gloss media or high gloss media may send information to the printer controller 12 and/or printer formatter 15 to indicate the availability or unavailability of a particular kind of media.

Printer controller 12, performs several functions at the direction of formatter 13 or in response to direct input from sensor 26 or the printer control panel, not shown, or a combination of any of the three. First, printer controller 12 can select either low gloss media from first paper tray 21 or selection of high gloss media from second paper tray 23 depending on the mode selected. Second, printer controller 12 selects feed rate for the media through the printing process, which in this embodiment is selected from a range of feed speeds from twelve cm/sec to seventy-five cm/sec. The rate of feed is determined by feed motor 14 which is controlled by speed control 16. Similarly, printer controller 12 also controls the selection of a temperature for fuser rollers 17 which, in this embodiment, is selected from a range of temperatures from 170° C. to 190° C., once again based upon selection of mode by printer controller 12. The temperature of fuser rollers 17 is controlled by heating element 24.

In the case in which a low gloss copy or document is desired, low gloss media is selected from first paper tray 21. Because this process employs dry low gloss toner with low gloss media, all other parameters of the process are consistent with known parameters for the production of electrophotographic low gloss color and black and white images using dry toner formulations.

When a high gloss document is desired, printer controller 12 selects high gloss media from second paper tray 23. Here the high gloss media is formulated having enhanced conductivity properties so that an increased charge differential is observed, as compared to low gloss media, to provide maximum toner coverage and increased density for maximum color gamut. In the high gloss mode, the rate of speed of the media through process is here approximately twelve cm/sec as controlled by speed control 16. Similarly, based upon selection of mode by printer controller 12, the temperature for fuser rollers 17 is set to 190° C. as controlled by heating element 24. Additionally, in the high gloss mode, printer controller 12 selects output tray 25, so that upon exit from printer 10, the high gloss media exits fuser rollers 17 and remains flat while the image cools.

While there is shown and described the preferred embodiment of the invention, it is to be distinctly understood that this invention is not limited thereto but may be variously embodied to practice within the scope of the following claims.

What is claimed is:

1. An image forming device for selectively rendering an image in either a low gloss mode or a high gloss mode using only low gloss toner comprising:

an input for receiving a transmission of electronic data representing a document to be printed;

input means for inputting a desired mode selected as either a low gloss document on a low gloss media using a dry low gloss toner formulation or a high gloss document on a high gloss media using the dry low gloss toner formulation;

print control means being connected to the input means and configured to determine a gloss level for the image to be printed;

a print engine being connected to the print control means and the input for printing an image at the determined gloss level;

means for controlling a feed speed for media through the image forming device being responsive to the print control means and configured to feed media for a higher gloss finish at a reduced rate through the print engine as compared to a lower gloss finished image; and fusion means for fusing an image to a print media, the fusion means including a means for controlling a temperature for fusion connected and responsive to the print control means.

2. The image forming device of claim 1 further comprising means for selecting a media source from either a low gloss media source or a high gloss media source responsive to the input means.

3. The image forming device of claim 2 wherein the means for controlling a feed speed of the media has a maximum design feed speed for printing low gloss images which is approximately equal to the length of a total number of pages per unit time that the image forming device is capable of printing and higher gloss printing feed speeds of less than the maximum design feed speed.

4. The image forming device of claim 3 wherein the means for controlling a feed speed of the media has maximum design feed speed approximately equal to seventy-five centimeters per second and a high gloss feed speed approximately equal to twelve centimeters per second.

5. The image forming device of claim 4 wherein the fusion means varies temperature for fusion within an approximate range of 170° C. and 190° C.

6. The image forming device of claim 1 wherein the means for controlling a feed speed of the media has a maximum design feed speed for printing low gloss images which is approximately equal to the length of a total number of pages per unit time that the image forming device is capable of printing and higher gloss printing feed speeds of less than the maximum design feed speed.

7. A method for selectively rendering an image in either a low gloss mode or a high gloss mode comprising the steps of:

(a) receiving electronic data at an input in an image forming device, the data representing a document to be printed;

(b) receiving electronic data within the image forming device representing a gloss mode as either a low gloss document mode or a high gloss document mode and analyzing the data representing a gloss mode to distinguish between either a low gloss document mode or a high gloss document mode;

(c) for the low gloss document mode, selecting a low gloss media from a plurality of media sources based upon the selection of the low gloss document mode, feeding the low gloss media through the image forming device at or near a predetermined maximum feed speed for the image forming device, controlling a temperature for fusion of the dry low gloss toner to the low gloss media; and (d) for the high gloss document mode, selecting a high gloss media from the plurality of media sources reducing a feed speed of the media through the image forming device and increasing heat transfer for fusion of the dry low gloss toner to the high gloss media.

8. The method of claim 7 wherein the electronic data representing the gloss mode is generated with a document generating device and included with the data representing a document to be printed.

9. The method of claim 8 wherein the media is fed at a reduced speed in the high gloss document mode, with respect to the low gloss mode, and wherein heat transfer for fusion is increased in the high gloss document mode, with respect to the low gloss document mode.

10. The method of claim 7 wherein the electronic data representing the gloss mode is generated internally within the image forming device in response to the presence of high gloss media.

11. The method of claim 10 wherein the media is fed at a reduced speed in the high gloss document mode, with respect to the speed at which media is fed in the low gloss mode, and wherein the heat transfer in the fusion process is increased in the high gloss document mode, with respect to the temperature of fusion in the low gloss document mode.

12. The method of claim 7 wherein the electronic data representing the gloss mode is generated at a control panel on the image forming device in response to user interaction.

13. The method of claim 12 wherein the media is fed at a reduced speed in the high gloss document mode, with respect to the speed at which media is fed in the low gloss mode, and wherein the heat transfer in the fusion process is increased in the high gloss document mode, with respect to the temperature of fusion in the low gloss document mode.

14. The method of claim 7 wherein the media is fed at a reduced speed in the high gloss document mode, with respect to low gloss mode, and wherein heat transfer for fusion is increased in the high gloss document mode, with respect to the low gloss document mode.

15. A system for selectively rendering an image in either a low gloss mode or a high gloss or range in-between mode comprising:

a document generating device being configured to generate and transmit electronic data representing a document to be printed and prefacing the electronic data with an electronic data command representing a desired mode selected as either a low gloss document mode wherein the document is printed on a low gloss media using a dry low gloss toner formulation or a high gloss document mode wherein the document is printed on a high gloss media, if available, using the dry low gloss toner;

an image forming device capable of being communicatively coupled with the document generating device for receiving transmissions therefrom, the image forming device including, an input for receiving a transmission of electronic data representing a document to be printed and an electronic transmission of data representing a desired mode selected as either a low gloss document on a low gloss media using a dry low gloss toner formulation or a high gloss document on a high gloss media using the dry low gloss toner formulation;

print control means being connected to the input means and the input, and configured to determine a gloss level for the image to be printed;

a print engine being connected to print control means for printing an image at the determined gloss level;

means for controlling a feed speed of media through the image forming device being connected to and controlled by the print control means and configured to feed media for a higher gloss finish at a reduced rate through the print engine as compared to a lower gloss finished image;

fusion means for fusing an image to a print media, the fusion means including a means for controlling a temperature for fusion to media and being connected to and controlled by the print control means.

16. The image forming device of claim 15 further comprising means for selecting a media source from either a low gloss media source or a high gloss media source responsive to the input means.

17. The image forming device of claim 16 wherein the means for controlling a feed speed of the media has a maximum design feed speed for printing low gloss images which is approximately equal to the length of a total number of pages per unit time that the image forming device is capable of printing and higher gloss printing feed speeds of less than the maximum design feed speed.

18. The image forming device of claim 17 wherein the means for controlling a feed speed of the media has maximum design feed speed approximately equal to seventy-five centimeters per second and a high gloss feed speed approximately equal to twelve centimeters per second.

19. The image forming device of claim 18 wherein the fusion means varies temperature for fusion within an approximate range of 170° C. and 190° C.

20. The image forming device of claim 15 wherein the means for controlling the feed speed of the media has a maximum design feed speed for printing low gloss images which is approximately equal to the length of a total number of pages per unit time that the image forming device is capable of printing and higher gloss printing feed speeds of less than the maximum design feed speed.

* * * * *